US010794071B2

(12) United States Patent
Potthoff et al.

(10) Patent No.: US 10,794,071 B2
(45) Date of Patent: Oct. 6, 2020

(54) DRYWALL SCAFFOLD ROLLER LIFT

(71) Applicants: Loren Jay Potthoff, Englewood, CO (US); Wanda Jean Potthoff, Englewood, CO (US)

(72) Inventors: Loren Jay Potthoff, Englewood, CO (US); Wanda Jean Potthoff, Englewood, CO (US)

( * ) Notice: Subject to any disclaimer, the term of this patent is extended or adjusted under 35 U.S.C. 154(b) by 0 days.

(21) Appl. No.: 15/932,851

(22) Filed: May 8, 2018

(65) Prior Publication Data

US 2019/0345726 A1 Nov. 14, 2019

(51) Int. Cl.
*E04G 21/16* (2006.01)
*E04G 5/00* (2006.01)

(52) U.S. Cl.
CPC ..... *E04G 21/16* (2013.01); *E04G 2005/008* (2013.01)

(58) Field of Classification Search
CPC ... E04F 21/18; E04F 21/1805; E04F 21/1811; E04F 21/1816; E04F 21/1822; E04F 21/1827; E04F 21/1833; E04F 21/1838; E04F 21/1844; E04F 21/185; E04F 21/1855; E04F 21/1861; E04F 21/1866; E04F 21/1872; E04F 21/1877; E04F 21/1883; E04F 21/1888; E04F 21/1894; E04G 21/16; E04G 2005/008
USPC ..... 414/11
See application file for complete search history.

(56) References Cited

U.S. PATENT DOCUMENTS 3,871,477 A * 3/1975 Kuest ..... B66F 11/04 182/69.4
7,448,598 B1 * 11/2008 Elmlinger ..... B66D 1/28 254/338
8,287,221 B1 * 10/2012 Van Roekel ..... E04G 21/168 414/11
2002/0159863 A1 * 10/2002 Ray ..... B66F 11/044 414/11
2005/0098769 A1 * 5/2005 Raycraft ..... E04F 21/1811 254/329

* cited by examiner

*Primary Examiner* — William V Gilbert

(57) ABSTRACT

The drywall scaffold roller ("DSR") is a lightweight tool weighing approximately two pounds that construction workers who hang drywall (or plywood) can use to roll the heavy material from the ground to the workers on a scaffold instead of lifting it themselves using their back, arms and legs, which causes injuries.

Currently, a drywaller on the ground physically lifts a 100+ pound sheet of drywall, plywood or other heavy materials upwards as much as 20 feet to the person on the scaffold, who then has to lift and/or pull the materials up onto the scaffold. Both people must use their arms, knees, shoulders and back to lift the heavy material, and the worker on the scaffold sometimes uses his foot to slide the material up onto the scaffold. The DSR helps eliminate this unsafe lifting procedure by providing a rolling mechanism to roll the sheet of material instead of lifting it. This takes most of the weight of the heavy material off the workers, making it safer and easier, and possibly reducing arm, shoulder, back and foot injuries from manually lifting the heavy sheet of drywall. It is an inexpensive way for drywall and construction companies to more likely than not reduce the number of workplace injuries and worker's compensation claims.

1 Claim, 10 Drawing Sheets

DRYWALL SCAFFOLD ROLLER LIFT

CROSS-REFERENCE TO RELATED APPLICATIONS

Provisional Application No. 62/761,372 filed Mar. 22, 2018.

STATEMENT REGARDING FEDERALLY SPONSORED RESEARCH OR DEVELOPMENT

Not applicable.

REFERENCE TO A "SEQUENCE LISTING"

None.

HISTORY/SUMMARY/BACKGROUND OF THE APPLICATION

This invention was created by a man who has worked in the construction industry his entire adult life and spent many hours lifting 4'×8' or 4'×12' sheets of drywall weighing approximately 100 pounds or more from the ground up onto a scaffold, either by himself and/or with the help of others. He came up with the idea for a roller to slide the drywall to help get the drywall up to the workers on the scaffold by rolling it on the drywall scaffold roller, reducing the damage to his body, including his arms, legs, back and feet. He and an employee used the prototype several times on jobs to roll drywall up onto the scaffold.

The drywall scaffold roller ("DSR") is a lightweight tool weighing approximately two pounds that construction workers who hang drywall (or plywood) can use to roll the heavy material from the ground to the workers on a scaffold instead of lifting it by himself using his back, arms and legs, which causes injuries. The worker stands the drywall or other material on end, leans it against the roller, and rolls it upwards to the person on the scaffold instead of lifting the drywall up to the guy on the scaffold.

This lift roller fits the Safeway scaffolding with the round frames.

BRIEF DESCRIPTION OF THE DRAWINGS

Drawings are attached that include specifications and views of the various parts of the drywall scaffold roller as follows.

DETAILED DESCRIPTION OF THE INVENTION

Figure 1:
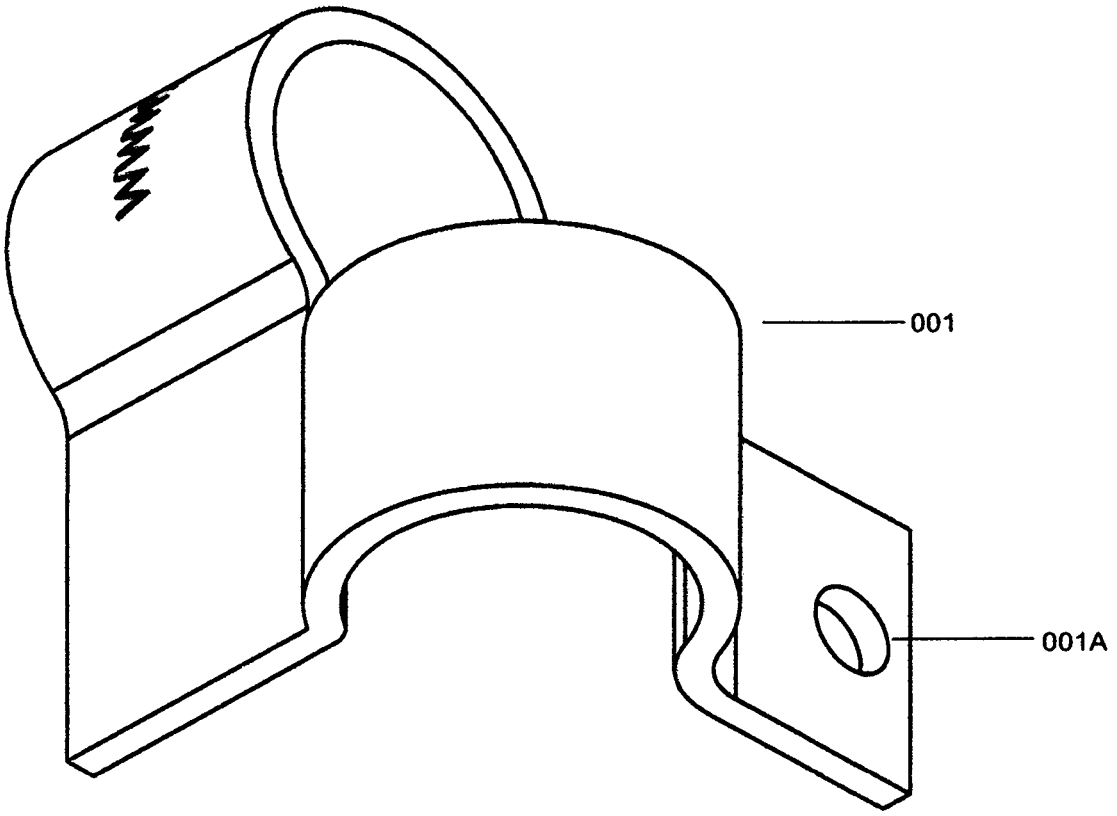
FIG. 1 is the main metal frame for the roller.
Figure 2:
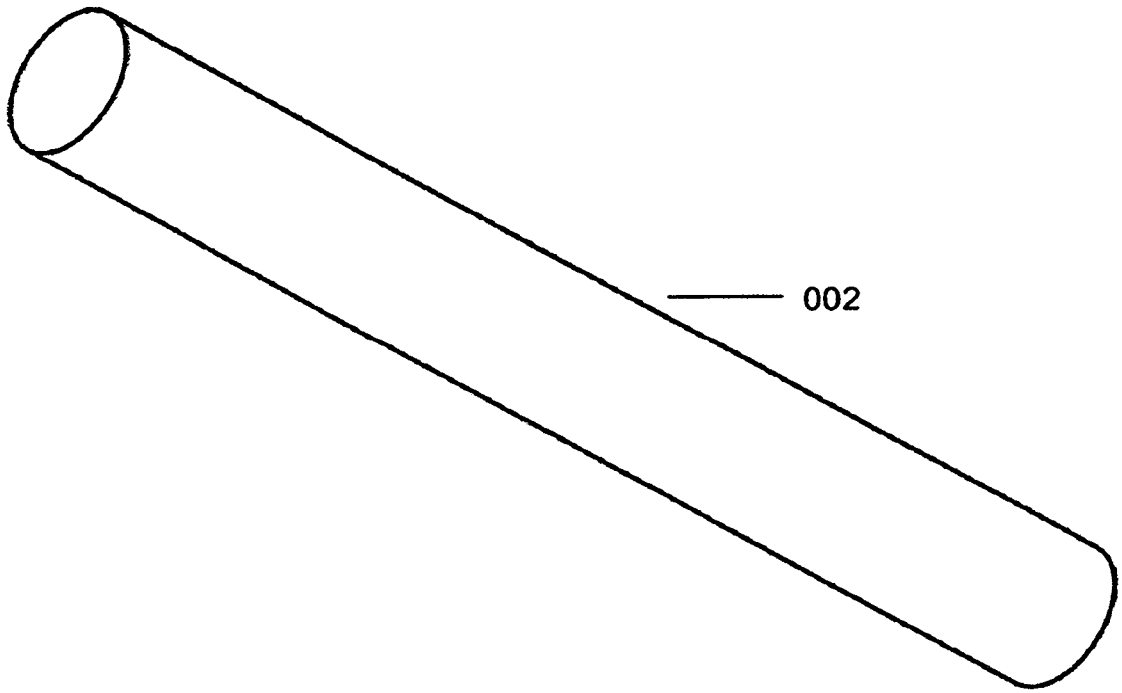
FIG. 2 is a half inch (0.500") metal rod.
Figure 3:
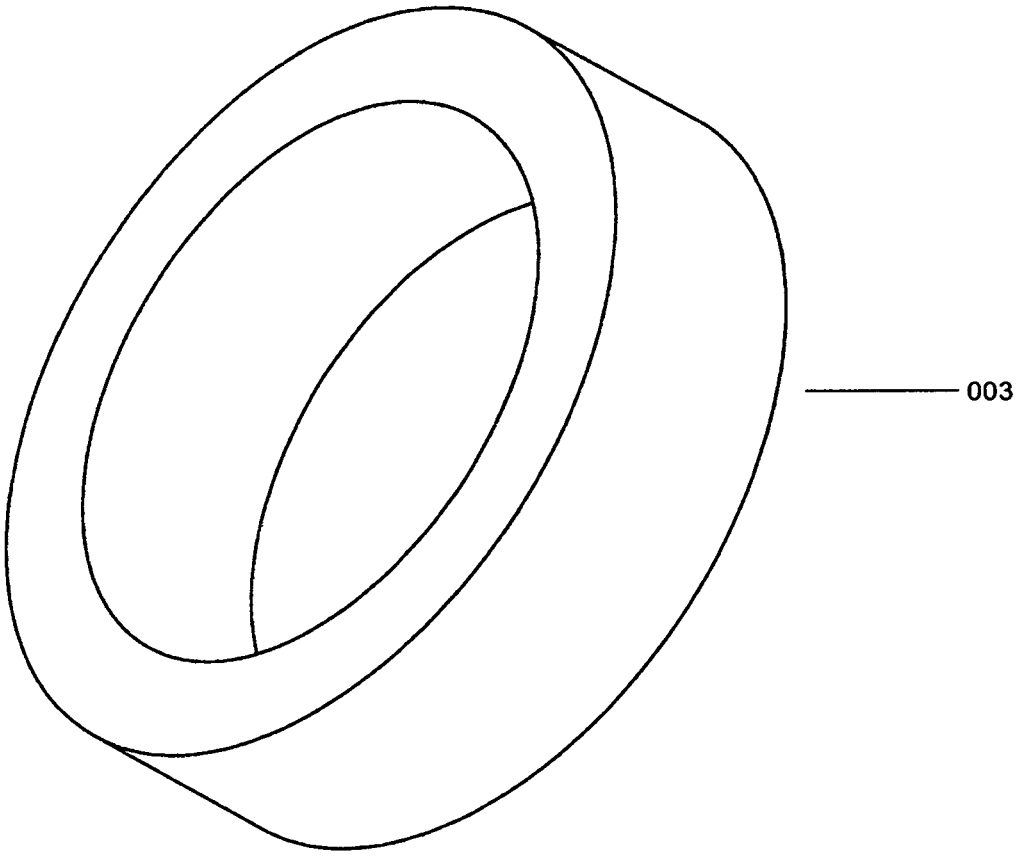
FIG. 3 is a one-quarter inch (0.250") UHMW plastic washer.
Figure 4:
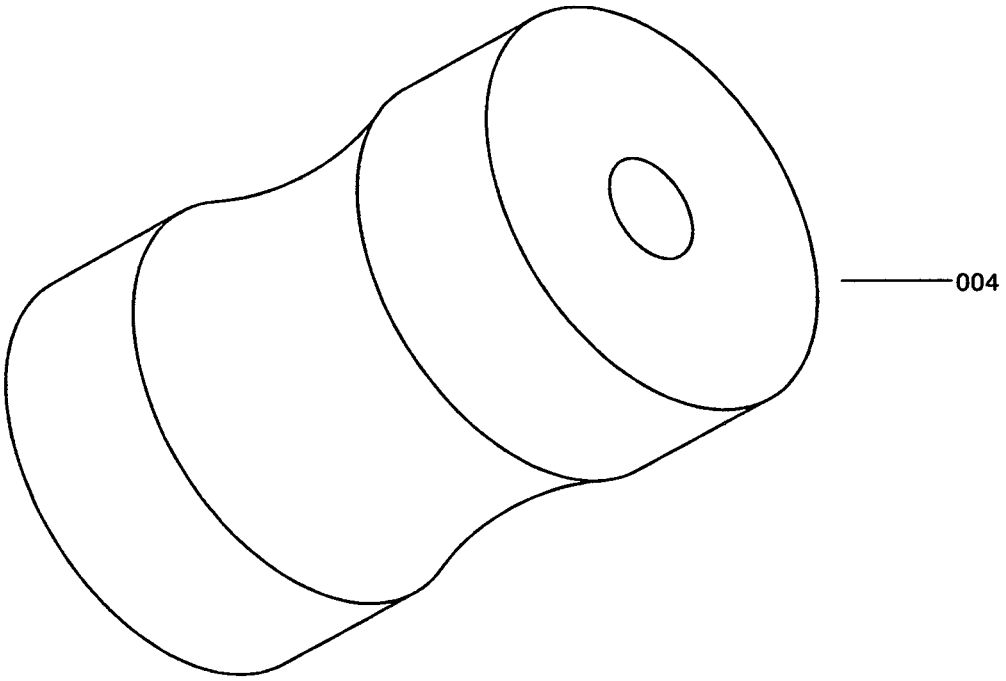
FIG. 4 is the UHMW 2" roller.
Figure 5:
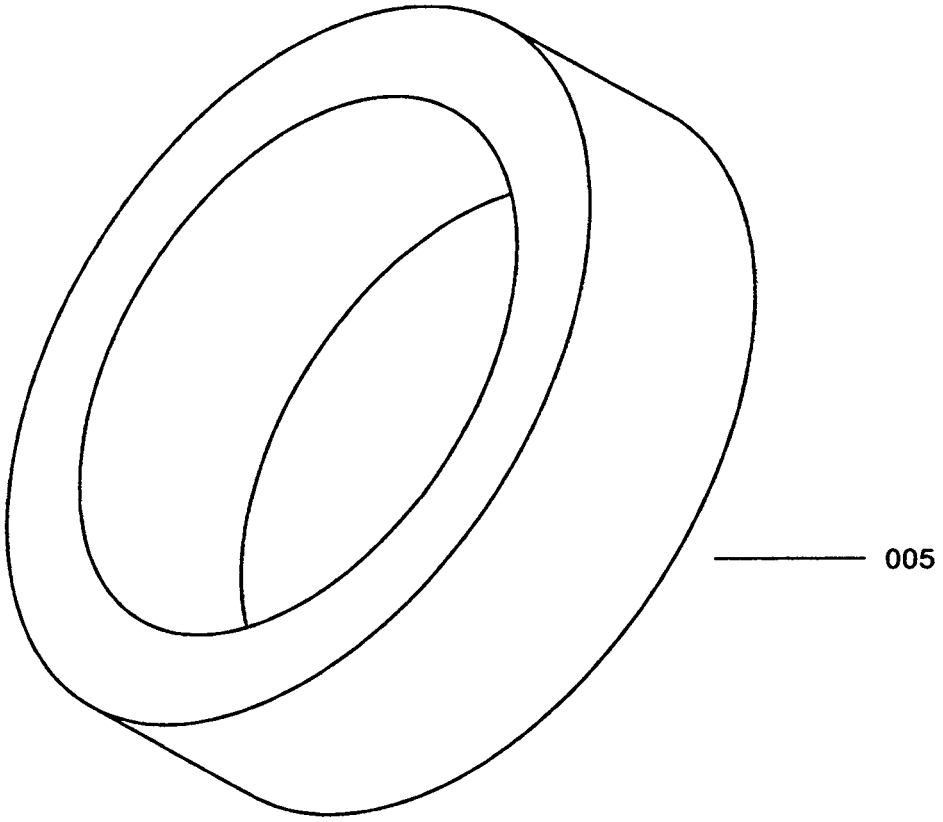
FIG. 5 is a 3/16" UHMW plastic washer/spacer.
Figure 6:
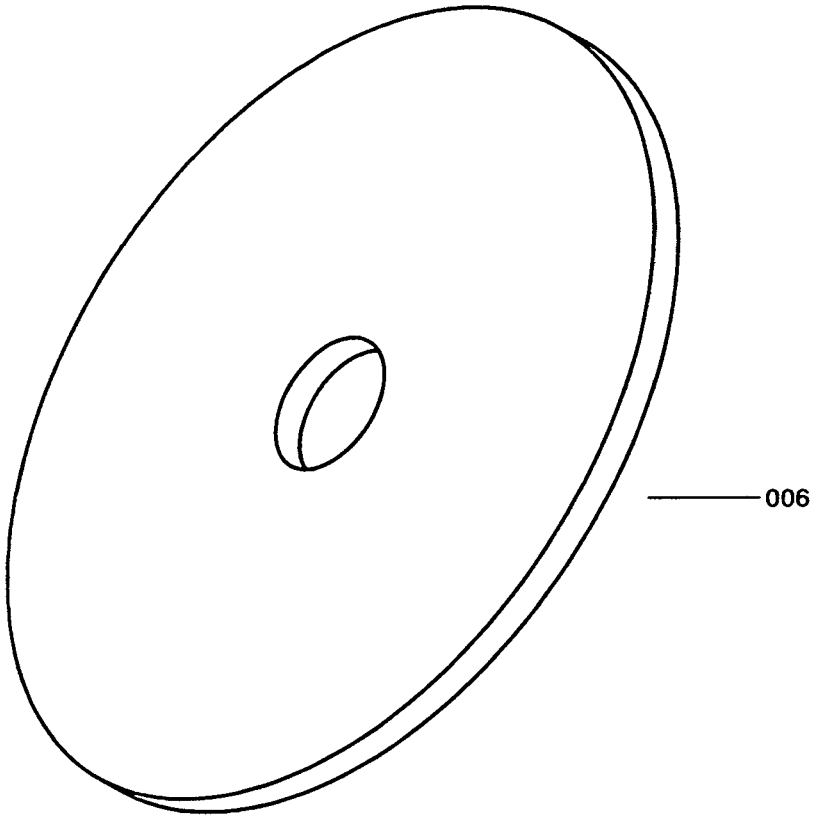
FIG. 6 is a 3" round 20 gauge metal disc.
Figure 7:
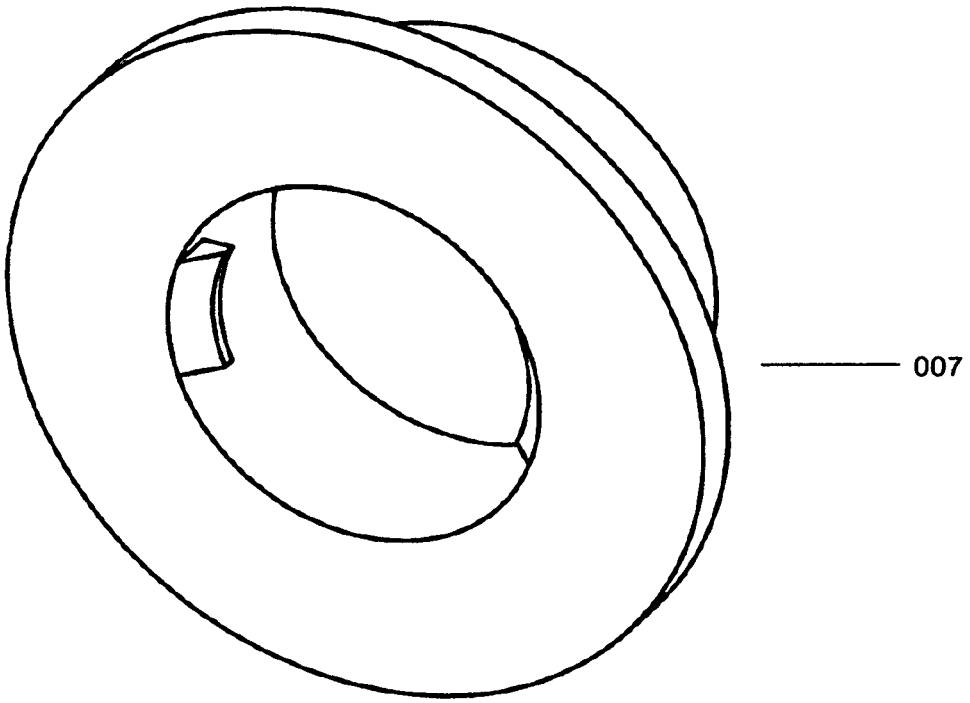
FIG. 7 is a metal cap.
Figure 8:
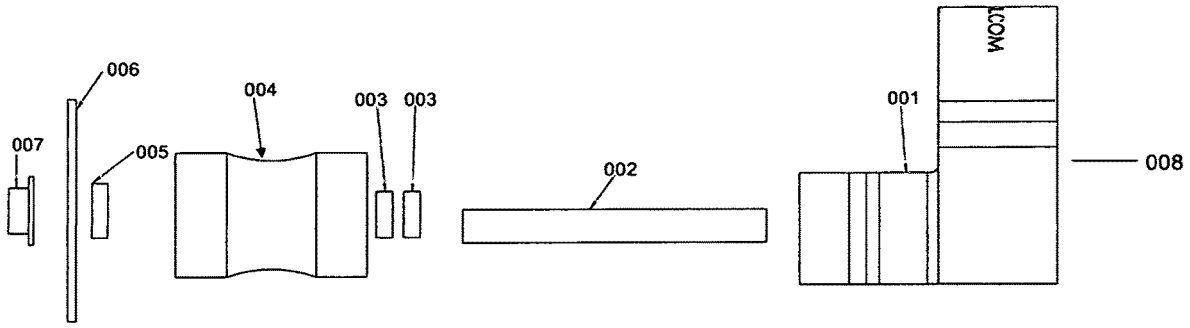
FIG. 8 is the assembly procedure for the DSR tool.
Figure 9:
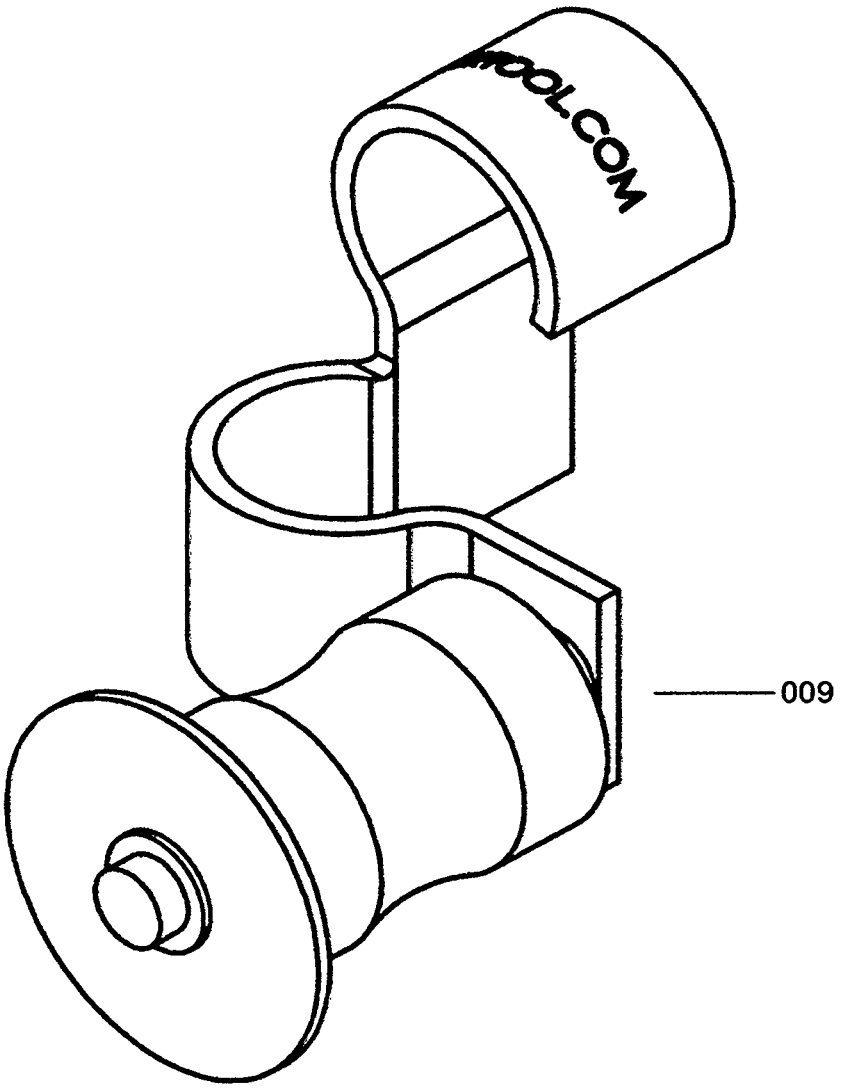
FIGS. 9 and 10 are different views of the completely assembled DSR tool.
Figure 10:
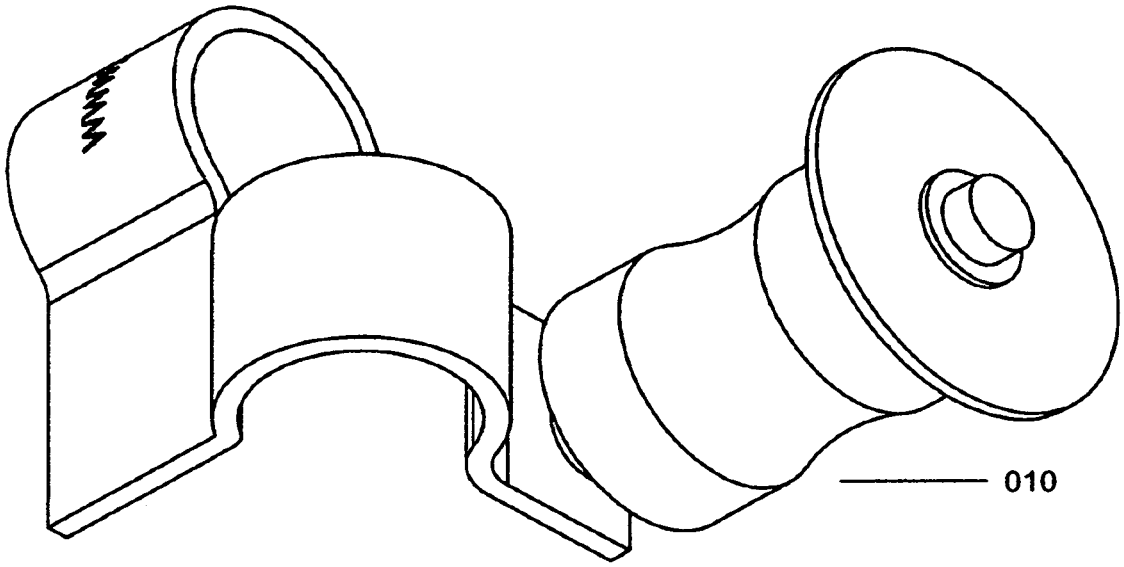

The body of the frame 001 hooks onto the Safeway scaffold.

A half inch (0.500) 002 metal rod is inserted into the body of the frame 001A and welded to the back side of the frame.

Two one-quarter inch (0.250) washers 003 go over the half inch rod 002 and slides all the way to the back of the rod to the frame.

A roller 004 slides over the half inch (0.500) rod 002 to the washer 003.

The 3/16" washer 005 slides over the half inch (0.500) rod 002 to the roller 004.

The three inch round metal 24 gauge disc 006 slides over the rod 002 abutting to the 3/16" waster 005.

The metal cap 007 slides over the half inch (0.500) rod 002 and is tapped into place so that it locks the rod 002 to the roller 004.

Assembly procedure 008

Assembled roller 009 and 010

PATENT CITATIONS REFERENCED

Other items that could be used to accomplish the same thing are:

1. Elmlinger (U.S. Pat. No. 7,448,598) for lifting entire panels of walls from the ground into a standing position for installation;
2. Kuest (U.S. Pat. No. 3,871,477) which is a complex scaffold/lift combination that is a heavy tool requiring cranking to lift the material;
3. Raycraft (U.S. Publication 2005-0098769), which is similar to a ceiling mounted pulley system;
4. Ray (U.S. Publication 2002/0159863 A1) is a lifting platform that lifts multiple pieces of drywall, plywood or other materials using a pulley system to lift it up to the desired level where the material is being installed. Upper and lower clamps are used to clamp the platform to something (the publication is not clear on this). This appears to take some time to set up before using; and
5. Van Roekel (U.S. Pat. No. 8,287,221) that is a system for lifting entire walls that have been assembled horizontally on the ground and need to be lifted into a vertical position.

Unlike the above patents, the DSR Tool is a small, lightweight, portable tool that requires no set up, no assembly and no cranking or pulley to lift the materials. It is designed specifically for rolling heavy drywall, plywood and other materials from the ground up to a person on a scaffold instead of lifting it. You merely roll the material upward to a person on the scaffold.

APPLICATIONS CLAIMING PRIORITY

Provisional Application No. 62/761,372 filed Mar. 22, 2018.
Application Ser. No. 15/932,851, filed May 8, 2018.

The invention claimed is:

1. A tool for lifting drywall, comprising:

(a) a hanger flange, said hanger flange having a four-sided portion having a first side and a second side opposite said first side and a third side opposite a fourth side, a first hook member connected to said first side and a second hook member connected to said third side, said third side adjacent said first side, and an additional flange connected to a distal end of said first hook member, said distal end being with respect to said four-sided portion, said additional flange having an aperture extending through a thickness of said additional flange;

(b) a shaft having a first end and a second end, said first end extending into said aperture;

(c) a first spacer and a second spacer each having an aperture, said shaft extending through said aperture of said spacer and said second spacer, said first spacer abutting said additional flange and said second spacer abutting said first spacer;

(d) a roller having a first end and a second end opposite said first end and an aperture extending from said first end to said second end of said roller, said shaft extending through said aperture of said roller, said first end of said roller abutting said second spacer;

(e) a third spacer having an aperture, said shaft extending through said aperture of said third spacer, said third spacer abutting said second end of said roller;

(f) a washer having an aperture, said shaft extending through said aperture of said washer, said washer abutting said third spacer;

(g) a push ring cup placed on said second end of said shaft.

* * * * *